United States Patent [19]

Shimizu et al.

[11] 4,403,026

[45] Sep. 6, 1983

[54] PHOTOCONDUCTIVE MEMBER HAVING AN ELECTRICALLY INSULATING OXIDE LAYER

[75] Inventors: Isamu Shimizu, Yokohama; Shigeru Shirai, Yamato; Eiichi Inoue, Tokyo, all of Japan

[73] Assignee: Canon Kabushiki Kaisha, Tokyo, Japan

[21] Appl. No.: 310,481

[22] Filed: Oct. 9, 1981

[30] Foreign Application Priority Data

Oct. 14, 1980 [JP] Japan ..... 55-143451
Oct. 14, 1980 [JP] Japan ..... 55-143452

[51] Int. Cl.[3] ..... G03G 5/082

[52] U.S. Cl. ..... 430/65; 430/66; 430/84

[58] Field of Search ..... 430/60, 64, 65, 84, 430/95

[56] References Cited

U.S. PATENT DOCUMENTS

| | | | |
|---|---|---|---|
| 3,393,070 | 7/1968 | Snelling | 430/65 |
| 4,226,898 | 10/1980 | Oushinsky et al. | 430/84 |
| 4,265,991 | 5/1981 | Hirai et al. | 430/65 |

*Primary Examiner*—John E. Kittle
*Assistant Examiner*—John L. Goodrow
*Attorney, Agent, or Firm*—Fitzpatrick, Cella, Harper & Scinto

[57] ABSTRACT

A photoconductive member comprises a support, a photoconductive layer constituted of an amorphous material containing hydrogen atoms or halogen atoms in a matrix of silicon atoms, and an intermediate layer constituted of an electrically insulating oxide having a layer thickness of 30 to 1000Å, which is provided between said support and said photoconductive layer.

34 Claims, 4 Drawing Figures

PHOTOCONDUCTIVE MEMBER HAVING AN ELECTRICALLY INSULATING OXIDE LAYER

BACKGROUND OF THE INVENTION

1. Field of the Invention

This invention relates to a photoconductive member having a sensitivity to electromagnetic waves such as light [herein used in a broad sense, including ultraviolet rays, visible light, infrared rays, X-rays and gamma-rays].

2. Description of the Prior Art

Photoconductive materials, which constitute image forming members for electrophotography in solid state image pickup devices or in the field of image formation, or photoconductive layers in manuscript reading devices, are required to have a high sensitivity, a high SN ratio [photocurrent($I_p$)/Dark current($I_d$)], spectral characteristics corresponding to those of electromagnetic waves to be irradiated, a good response to light, a desired dark resistance value as well as no harm to human bodies during usage. Further, in a photographic device, it is also required that the residual image should easily be treated within a predetermined time. In particular, in case of an image forming member for electrophotography to be assembled in an electrophotographic device to be used in an office as office apparatus, the aforesaid safety characteristics is very important.

From the standpoint as mentioned above, amorphous silicon [hereinafter referred to as a-Si] has recently attracted attention as a photoconductive material. For example, German Laid-open Patent Publication Nos. 2746967 and 2855718 disclose applications of a-Si for use in image forming members for electrophotography, and U.K. Laid-open Patent Publication No. 2029642 an application of a-Si for use in a photoconverting reading device. However, the photoconductive members having photoconductive layers constituted of a-Si of prior art have various electrical, optical and photoconductive characteristics such as dark resistance value, photosensitivity and response to light as well as environmental characteristics in use such as weathering resistance and humidity resistance, which should further be improved. Thus, in a practical solid state image pickup device, reading device or an image forming member for electrophotography, they cannot effectively be used also in view of their productivity and possibility of their mass production.

For instance, when applied in an image forming member or an image pickup device, residual potential is frequently observed to be remained during use thereof. When such a photoconductive member is repeatedly used for a long time, there will be caused various inconveniences such as accumulation of fatique by repeated uses or so called ghost phenomenon wherein residual images are formed.

Further, according to the experience by the present inventors from a number of experiments, a-Si material constituting the photoconductive layer of an image forming member for electrophotography, while it has a number of advantages, as compared with Se, ZnO or organic photoconductive materials such as PVCz, TNF, and the like of prior art, is also found to have several problems to be solved. Namely, when charging treatment is applied for formation of electrostatic images on the photoconductive layer of an image forming member for electrophotography having a photoconductive member constituted of a mono-layer of a-Si which has been endowed with characteristics for use in a solar battery of prior art, dark decay is markedly rapid, whereby it is difficult to apply a conventional electrophotographic method. This tendency is further pronounced under a humid atmosphere to such an extent in some cases that no charge is retained at all before development.

Thus, it is required in designing of a photoconductive material to make efforts to obtain desirable electrical, optical and photoconductive characteristics along with the improvement of a-Si materials per se.

In view of the above points, the present invention contemplates the achievement obtained as a result of extensive studies made comprehensively from the standpoints of applicability and utility of a-Si as a photoconductive member for image forming members for electrophotography, image pickup devices or reading devices. It has now been found that a photoconductive member formed to have a layer structure comprising a photoconductive layer constituted of a so called hydrogenated amorphous silicon [hereinafter referred to as a-Si:H], which is an amorphous material containing hydrogen in a matrix of silicon, or a so called halogen-containing amorphous silicon [hereinafter referred to as a-Si:X], which is an amorphous material containing halogen atoms(X) in a matrix of silicon atoms, and a specific intermediate layer sandwiched between said photoconductive layer and a support which supports said photoconductive layer, is not only actually useful but also has characteristics superior in substantially all respects to those of the photoconductive members of prior art, especially markedly excellent characteristics as a photoconductive member for electrophotography. The present invention is based on this finding.

SUMMARY OF THE INVENTION

The primary object of the present invention is to provide a photoconductive member having constantly stable electrical, optical and photoconductive characteristics, which is an all-environment type substantially without limitations with respect to the environment under which it is used, being markedly excellent in light-resistant fatique without deterioration after repeated uses and free entirely or substantially from residual potentials observed.

Another object of the present invention is to provide a photoconductive member, having a high photosensitivity with a spectral sensitive region covering substantially all over the region of visible light, and having also a rapid response to light.

Still another object of the present invention is to provide a photoconductive member, which is sufficiently capable of retaining charges at the time of charging treatment for formation of electrostatic images to the extent such that a conventional electrophotographic method can be applied when it is provided for use as an image forming member for electrophotography, and which has excellent electrophotographic characteristics of which substantially no deterioration is observed even under a highly humid atmosphere.

Further, still another object of the present invention is to provide a photoconductive member for electrophotography capable of providing easily a high quality image which is high in density, clear in halftone and high in definition.

Still further object of the present invention is to provide a photoconductive member, comprising a support, a photoconductive layer constituted of an amorphous material containing hydrogen atoms or halogen atoms in a matrix of silicon atoms, and an intermediate layer constituted of an electrically insulating oxide having a layer thickness of 30 to 1000 Å, which is provided between said support and said photoconductive layer.

According to one aspect of the present invention, there is to provide a photoconductive member, comprising a support, a photoconductive layer constituted of an amorphous material containing hydrogen atoms or halogen atoms in a matrix of silicon atoms, and an intermediate layer constituted of an electrically insulating oxide having a layer thickness of 30 to 1000 Å, which is provided between said support and said photoconductive layer.

According to another aspect of the present invention, there is to provide a photoconductive member, comprising a support, a photoconductive layer constituted of an amorphous material containing matrix of silicon atoms, and an intermediate layer, provided between said support and said photoconductive layer, having the function of being capable of barring penetration of carriers from the side of the support into the photoconductive layer, said intermediate layer being constituted of an electrically insulating metal oxide and having a layer thickness of 30 to 1000 Å.

DETAILED DESCRIPTION OF THE PREFERRED EMBODIMENTS

Figure 1:
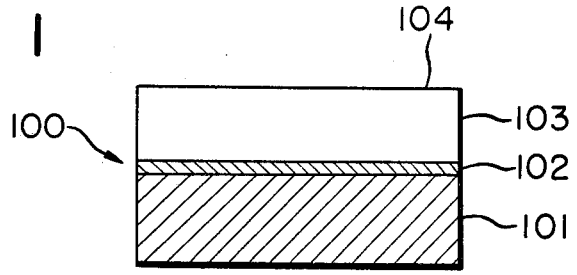
FIGS. 1 and 2 show schematic sectional views of the embodiments of the photoconductive members according to the present invention, respectively.

Referring now to the drawing, the photoconductive members according to the present invention are to be described in detail below.

FIG. 1 shows a schematic sectional view for illustration of the basic embodiment of the photoconductive member of this invention.

The photoconductive member 100 as shown in FIG. 1 is one of the most basic embodiment, having a layer structure comprising a support 101 for photoconductive member, an intermediate layer 102 provided on said support and a photoconductive layer 103 provided in direct contact with said intermediate layer 102.

The support 101 may be either electroconductive or insulating. As the electroconductive material, there may be mentioned metals such as NiCr, stainless steel, Al, Cr, Mo, Au, Ir, Nb, V, Ti, Pt, Pd, etc. or alloys thereof.

As insulating supports, there may usually be used films or sheets of synthetic resins, including polyesters, polyethylene, polycarbonates, cellulose acetate, polypropylene, polyvinyl chloride, polyvinylidene chloride, polystyrene, polyamides, etc., glasses, ceramics, papers and the like. These insulating supports may suitably have at least one surface subjected to electroconductive treatment, and it is desirable to provide other layers on the side to which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO($In_2O_3+SnO_2$) thereon. Alternatively, a synthetic resin film such as polyester film can be subjected to the electroconductive treatment on its surface by vapor deposition, electron-beam deposition or sputtering of a metal such as NiCr, Al, Ag, pb, Zn, Ni, Au, Cr, Mo, Ir, Nb, Ta, V, Ti, Pt, etc. or by laminating treatment with said metal. The support may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The support may have a thickness, which is conveniently determined so that a photo-conductive member as desired may be formed. When the photo-conductive member is required to have a flexibility, the support is made as thin as possible, so far as the function of a support can be exhibited. However, in such a case, the thickness is generally 10μ or more from the points of fabrication and handling of the support as well as its mechanical strength.

The intermediate layer 102 is constituted of electrically insulating oxides, which has the function of a so called barrier layer capable of barring effectively penetration of carriers into the photoconductive layer 103 from the side of the support 101 and permitting easily the photocarriers generated by irradiation of electromagnetic waves to which the photoconductive layer has a sensitivity, in the photoconductive layer 103 and migrating toward the support 101 to pass therethrough from the side of the photoconductive layer 103 to the side of the support 101.

The material constituting the intermediate layer 102 may be selected as desired from those capable of forming a layer which can exhibit the function as described above.

Such materials constituting the intermediate layer 10 may include electrically insulating inorganic oxides, especially desirably metal oxides.

As the electrically insulating inorganic oxides effectively used as the intermediate layer 102 in the present invention, there may be mentioned, for example, $Al_2O_3$, BaO, $BaO_2$, BeO, $Bi_2O_3$, CaO, $CeO_2$, $Cr_2O_3$, CuO, $Cu_2O$, FeO, PbO, MgO, SrO, $Ta_2O_5$, $ThO_2$, $ZrO_2$, $HfO_2$, $GeO_2$, $Y_2O_3$, $TiO_2$, $Ce_2O_3$, MgO, $MgO.Al_2O_3$, $SiO_2.MgO$, etc. A mixture of two or more kinds of these compounds may also be used to form the intermediate layer 102. The material for forming the intermediate layer 102, which is selected and used depending on the desirable characteristics, may desirably be one which is excellent in structural stability or chemical stability.

The intermediate layer 102 constituted of electrically insulating oxides may be formed by the vacuum deposition method, the CVD (chemical vapor deposition) method, plasma CVD method, the glow discharge decomposition method, the sputtering method, the ion implantation method, the ion plating method, the electron-beam method or the like. These production methods are suitably selected depending on the factors such as production conditions, the degree of loading of installation capital investment, production scale, the desirable characteristics of the photoconductive members to be prepared, etc.

For formation of the intermediate layer 102 by the sputtering method, for example, a wafer of a starting material for formation of an intermediate layer may be used as target and subjected to sputtering in an atmosphere of various gases such as He, Ne, Ar, and the like.

When the electron-beam method is used, there is placed a starting material for formation of the intermediate layer in a boat for deposition, which may in turn be irradiated by an electron beam to effect vapor deposition of said material.

When the ion plating method is used, various gases are introduced into a vapor deposition tank and a high frequency electric field is applied to the coil previously rolled around the tank to effect a glow discharging, under such state a starting material for formation of intermediate layer is vapor deposited by utilizing the electron beam method.

The intermediate layer 102 in the present invention is formed carefully so that the characteristics required may be given exactly as desired.

That is, a substance constituted of metal atoms(M) and oxygen atoms(O) can have various properties and forms depending on the preparation conditions. Since the function of the intermediate layer 102 of this invention is to bar penetration of carriers from the side of the support 101 into the photoconductive layer 103, while permitting easily the photocarriers generated in the photoconductive layer 103 to be migrated and passed therethrough to the side of the support 101, the metal oxide which is one of the materials constituting the intermediate layer 102 is selected and used so as to exhibit electrically insulating behaviors.

As another critical element in the conditions for preparation of the intermediate layer 102 having a mobility value with respect to passing carriers to the extent that passing of photocarriers generated in the photoconductive layer 103 may be passed smoothly through the intermediate layer 102, there may be mentioned the support temperature during preparation thereof.

In other words, in forming an intermediate layer 102 constituted of an electrically insulating inorganic oxide on the surface of the support 101, the support temperature during the layer formation is an important factor affecting the constitution and characteristics of the layer formed. In the present invention, the support temperature during the layer formation is severely controlled so that the oxide having the intended characteristics may be prepared exactly as desired.

In order that the objects of the present invention may be achieved effectively, the support temperature during formation of the intermediate layer 102, which is selected conveniently within an optimum range depending on the method employed for formation of the intermediate layer 102 to perform formation of the intermediate layer 102, is generally 20° to 250° C., preferably 20° to 200° C. For formation of the intermediate layer 102, it is advantageous to adopt the sputtering method or the electron beam method, since these methods can afford severe controlling of the atomic ratios constituting each layer or layer thickness with relative ease as compared with other methods, when forming continuously the photoconductive layer 103 on the intermediate layer in the same system, and further a third layer formed on the photoconductive layer 102, if desired. In case of forming the intermediate layer 102 according to these layer forming methods, the discharging power during layer formation may also be mentioned, similarly as the support temperature as described above, as an important factor influencing the characteristics of the oxide to be prepared.

In such methods for preparation of the intermediate layer, the discharging power condition for preparing effectively the oxide having characteristics for accomplishment of the object of this invention is generally 10 W to 250 W, preferably 30 W to 150 W.

The numerical range of the layer thickness of the intermediate layer 102 is also another important factor to achieve effectively the object of this invention.

That is, if the layer thickness of the intermediate layer is too thin, the function of barring penetration of carriers from the side of the support 101 into the photoconductive layer 103 cannot sufficiently be fulfilled. On the contrary, if the thickness is too thick, the probability of the photocarriers generated in the photoconductive layer 103 to be passed to the side of the support 101 is very small. Thus, in any of the cases, the objects of this invention cannot effectively be achieved.

The layer thickness to achieve effectively the objects of this invention is generally in the range of from 30 to 1000 Å, preferably from 50 to 600 Å.

In the present invention, in order to achieve its objects effectively, the photoconductive layer 103 laminated on the intermediate layer is constituted of an amorphous material containing at least one of hydrogen atom(H) and halogen atom(X) [hereinafter referred to as a-Si(H, X)] having the semi-conductor characteristics as shown below.

1 p-type a-Si:(H, X) . . . containing only acceptor; or containing both donor and acceptor with relatively higher concentration of acceptor(Na);

2 $p^-$-type a-Si:(H, X) . . . in the type of 1, that containing acceptor at relatively lower concentration;

3 n-type a-Si:(H, X) . . . containing only donor; or containing both donor and acceptor with relatively higher concentration of donor(Nd);

4 $n^-$-type a-Si:(H, X) . . . in the type of 3, that containing donor at relatively lower concentration(Nd);

5 i-type a-Si:(H, X) . . . $Na \simeq Nd \simeq O$ or $Na \simeq Nd$.

In the present invention, a-Si:(H, X) constituting the photoconductive layer 103, since it is provided through the intermediate layer 102 on the support, can be one having relatively lower electric resistance, but for obtaining better results, the dark resistance of the photoconductive layer 103 formed may preferably be $5\times10^9$ Ω cm or more, most preferably $10^{10}$ Ωcm or more.

In particular, the numerical condition for the dark resistance values is an important factor when using the prepared photoconductive member as an image forming member for electrophotography, as a high sensitive reading device or an image pickup device to be used under low illuminance regions, or as a photoelectric convertor.

The layer thickness of the photoconductives layer in the photoconductive member according to the present invention may suitably be determined as desired in conformity with the purpose of application such as reading device, image pickup device or image forming member for electrophotography.

In the present invention, the layer thickness of the photoconductive layer is determined suitably in relation to the thickness of the intermediate layer so that both the function of the photoconductive layer and the function of the intermediate layer may effectively be exhibited respectively to achieve effectively the objects of the present invention. Usually, the layer thickness of the photoconductive layer may preferably be some hundred to some thousand times as thick as that of the intermediate layer.

To be more specific, the value of the thickness is desired to be within the range from 1 to 100μ, preferably from 2 to 50μ.

In the present invention, for providing a photoconductive layer constituted of a-Si:(H, X), at least one of hydrogen atoms(H) or halogen atoms(X) are incorporated during formation of such a layer.

The expression "H is incorporated in the layer" herein mentioned, for example, means one of or a combination of the state, in which "H is bonded to Si", or in which "H is ionized to be incorporated in the layer", or in which "H is incorporated in a form of $H_2$ in the layer".

In the present invention, formation of a layer constituted of a-Si:(H, X) may be conducted according to the vacuum deposition method utilizing discharging phenomenon, such as glow discharge method, sputtering method, ion-plating method, and the like. For example, for formation of a-Si:(H, X) according to the glow discharge method, a starting gas for incorporation of hydrogen atoms or halogen atoms is introduced together with a starting gas for supplying silicon atoms(Si) capable of forming Si into the deposition chamber capable of being evacuated, wherein glow discharge is generated thereby to form a layer of a-Si:(H, X) on the surface of the intermediate layer previously formed on the surface of a support placed at a predetermined position in the chamber. When it is to be formed according to the sputtering method, a starting gas for incorporation of hydrogen atoms or halogen atoms may be introduced into the chamber for sputtering, when effecting sputtering upon the target formed of Si in an atmosphere of an inert gas such as Ar, He or a gas mixture based on these gases.

The starting gas for supplying Si to be used in the present invention may include gaseous or gasifiable silicon hydrides (silanes) such as $SiH_4$, $Si_2H_6$, $Si_3H_8$, $Si_4H_{10}$ and the like as effective materials. In particular, $SiH_4$ and $Si_2H_6$ are preferred with respect to easy handling during layer formation and efficiency for supplying Si.

As the method for incorporating hydrogen atoms(H) into the photoconductive layer, for example, silicon compounds such as silanes(silicon hydrides), including $SiH_4$, $Si_2H_6$, $Si_3H_8$, $Si_4H_{10}$, and the like are introduced in a gaseous state into a device system when forming a layer, and decomposing these compounds by the glow decomposition method to be incorporated in the layer simultaneously with the growth of the layer.

In forming the photoconductive layer by the glow discharge decomposition method, when a silicon hydride such as $SiH_4$, $Si_2H_6$, $Si_3H_8$, $Si_4H_{10}$, and the like is used as the starting material for supplying silicon atoms(Si), hydrogen atoms(H) are automatically incorporated in the layer when it is formed by decomposition of these compounds.

When the reaction sputtering method is used, $H_2$ gas is introduced into the system wherein sputtering is effected in an atmosphere of an inert gas such as He or Ar or a gas mixture containing these gases as the base, using Si as target, or alternatively gases of silicon hydrides such as $SiH_4$, $Si_2H_6$, $Si_3H_8$, $Si_4H_{10}$, and the like or gases such as $B_2H_6$, $PH_3$, and the like to concurrently effect doping, may be introduced thereinto.

Incorporation of halogen atoms(X) in the photoconductive layer is fundamentally the same as incorporation of hydrogen atoms as described above.

That is, in forming the photoconductive layer by, for example the glow discharge decomposition method, a starting gas for supplying Si and a starting gas for incorporating halogen atoms are employed. In the case of the sputtering method, a starting gas for introducing halogen atoms may be introduced into the vacuum deposition chamber at the time of sputtering of Si target.

As the effective starting gas for incorporation of halogen atoms to be used in the present invention, there may be mentioned a number of halogen compounds such as halogen gases, halides, interhalogen compounds and silane derivatives substituted with halogens which are gaseous or gasifiable.

Alternatively, there may be mentioned gaseous or gasifiable silicon compound containing halogen atoms which can supply both silicon atoms(Si) and halogen atoms(X) as effective starting materials in the present invention.

Typical examples of halogen compounds preferably used in the present invention may include halogen gases such as of fluorine, chlorine, bromine or iodine and interhalogen compounds such as BrF, ClF, $ClF_3$, $BrF_5$, $BrF_3$, $IF_7$, $IF_5$, ICl, IBr, etc.

As the silicon compound containing halogen atoms, silicon halides such as $SiF_4$, $Si_2F_6$, $SiCl_4$, $SiBr_4$, and the like are preferred.

When the specific photoconductive member of this invention is formed according to the glow discharge method by use of a silicon compound containing halogen atoms, a photoconductive layer constituted of a-Si:X can be formed on the predetermined support without using silicon hydride gases as the starting gas capable of supplying Si.

If forming the photoconductive layer of a-Si:X system according to the glow discharge method, the basic procedure comprises introducing a starting gas for supplying Si, namely a gas of silicon halides and a gas such as Ar, $H_2$, He, etc. at a predetermined ratio in a suitable amount into the deposition chamber for formation of the photoconductive member constituted of a-Si:X, followed by excitation of glow discharge to form a plasma atmosphere of these gases, thereby forming a photoconductive layer of a-Si:X directly contacted on the intermediate layer previously formed on the predetermined support. It is also possible to form a photoconductive layer of a-Si(H, X) containing both hydrogen and halogen atoms by mixing a gas of a silicon compound containing hydrogen atoms or other compounds containing hydrogen atoms at a predetermined ratio with these gases.

In this case, each of the gases for incorporation of respective atoms may be either a single species or a mixture of plural species at a predetermined ratio.

For formation of a photoconductive layer of a-Si:X by the reaction sputtering method or the ion-plating method, a target of Si is used and sputtering is effected thereon in a suitable gas plasma atmosphere in the case of the sputtering method. Alternatively, in case of ion-plating method, a polycrystalline or single crystalline silicon is placed as vaporization source in a vapor deposition boat, and the silicon vaporization source is vaporized by heating by resistance heating method, electron beam method(EB method), or the like thereby to permit vaporized silicon to pass through a suitable gas plasma atmosphere.

During this procedure, in either of the sputtering method or the ion-plating method, for incorporation of halogen atoms into the layer formed, gases of halogen compounds as mentioned above or a silicon compounds containing halogen as mentioned above may be introduced into the deposition chamber to form a plasma atmosphere of said gases therein.

In the present invention, as the starting material for incorporation of halogen atoms in forming the photoconductive layer, the halogen compounds or silicon compounds containing halogens as mentioned above can effectively be used. In addition, it is also possible to use effectively a gaseous or gasifiable halide containing hydrogen atom as a constituent such as hydrogen halide, including HF, HCl, HBr, HI and the like or halogen substituted silicon hydride, including $SiH_2F_2$, $SiH_2Cl_2$, $SiHCl_3$, $SiH_2Br_2$, $SiHBr_3$ and the like.

These halides containing hydrogen atom(H), which can incorporate hydrogen atoms(H) very effective for controlling electrical or optical characteristics into the layer during formation of the upper layer simultaneously with incorporation of halogen atoms, can preferably be used as the starting material for incorporation of halogen atoms.

The amount of hydrogen atoms(H) or halogen atoms(X) incorporated in the photoconductive layer of the photoconductive member according to the present invention, or total amount of both of these atoms in case that both hydrogen atoms and halogen atoms, may generally 1 to 40 atomic %, preferably 5 to 30 atomic %.

In order to make the photoconductive layer n-type, p-type or i-type, n-type impurity, p-type impurity or both which controls the conduction type can be added into the layer in a controlled amount during formation of the layer by the glow discharge method or the reactive sputtering method.

As the impurity to be added into the photoconductive layer to make it inclined for p-type, there may be mentioned preferably an element in the group III A of the periodic table, for example, B, Al, Ga, In, T1 etc.

On the other hand, for making the layer inclined for n-type, there may preferably be used an element in the group V A in the periodic table, such as N, P, As, Sb, Bi, etc.

The impurities as described above are contained in the layer in an amount on the order of ppm, and therefore it is not necessary to pay such a great attention to the pollution caused thereby as in case of the principal ingredients constituting the photoconductive layer, but it is also preferable to use a substance which is as less pollutive as possible. From such a standpoint, also in view of the electrical and optical characteristics of the layer formed, a material such as B, Ga, As, P, Sb, and the like is most preferred. In addition, for example, it is also possible to control the layer to n-type by interstitial doping with Li or others through thermal diffusion or implantation.

The amount of the impurity to be added into the photoconductive layer, which is determined suitably depending on the electrical and optical characteristics desired, but in the range of, in case of an impurity in the group III A of the periodic table, generally from $10^{-6}$ to $10^{-3}$ atomic ratio, preferably from $10^{-5}$ to $10^{-4}$ atomic ratio based on silicon atoms, and, in case of an impurity in the group V A of the periodic table, generally from $10^{-8}$ to $10^{-3}$ atomic ratio, preferably from $10^{-8}$ to $10^{-4}$ atomic ratio based on silicon atoms.

In case of a-Si:H, the so called non-doped a-Si:H, which is formed without adding the n-type impurity or the p-type impurity, will generally show slightly the tendency of n-type($n^-$-type). Accordingly, in order to obtain an i-type or near i-type a-Si:H, it is necessary to add an appropriate, although very small, quantity of p-type impurity in the non-doped a-Si:H.

Since a photoconductive member for electrophotography is required to have a sufficiently large dark resistance, it is desirable to constitute a photoconductive layer of non-doped a-Si:H or an i-type a-Si:H in which a p-type impurity such as B is added in a small quantity.

The content of H and/or X incorporated in the photoconductive layer can be controlled by controlling, for example, the temperature of the deposition support and/or the amounts of the starting materials used for incorporation of H or X introduced into the deposition chamber, discharging power etc.

Figure 2:
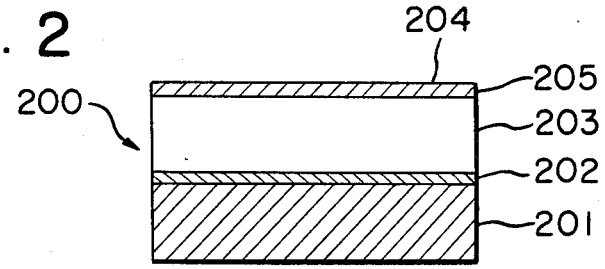

FIG. 2 shows a schematic sectional view of another embodiment of the photoconductive member of this invention. The photoconductive member 200 as shown in FIG. 2 has the same layer structure as the photoconductive member 100 as shown in FIG. 1, except that the upper layer 205 having the same characteristics as the intermediate layer 202 is provided on the photoconductive layer 203.

That is, the photoconductive member 200 has an intermediate layer 202 formed of the same material of an insulating oxide as in the intermediate layer 102 so as to have the same function, a photoconductive layer 203 constituted of a-Si:(H, X), and the upper layer 205 having the free surface 204, which is provided on said photoconductive layer 203. The upper layer 205 has the following characteristics. For example, when the photoconductive member 200 is used in a manner so as to form charge images by application of charging treatment on the free surface 204, it functions to bar penetration of charges to be retained on the free surface 204 into the photoconductive layer 203, and, when irradiated by electromagnetic waves, also to permit easily passage of the photocarriers generated in the photoconductive layer 203 so that the photocarriers may be recombined with the charges at portions irradiated by electromagnetic waves.

The upper layer 205 may be constituted of an oxide having the same characteristics as the intermediate layer 202. Moreover, it may be constituted of an amorphous material composed of silicon atoms(Si), which are the matrix atoms constituting the photoconductive layer 203, and any one of carbon atoms(C), nitrogen atoms(N) and oxygen atoms(O), or constituted of these atoms containing further at least one of hydrogen atoms(H) and halogen atoms(X), such as, for example, an amorphous silicon oxide($a-Si_aO_{1-a}$), $a-Si_bO_{1-b}$ containing at least one of hydrogen atoms(H) and halogen atoms(X); an amorphous silicon nitride $a-Si_cN_{1-c}$; $a-Si_dN_{1-d}$ containing at least one of hydrogen atoms(H) and halogen atoms(X); an amorphous silicon carbide $a-Si_eC_{1-e}$; $a-Si_fO_{1-f}$ containing at least one of hydrogen atoms(H) and halogen atoms(X); etc. [wherein $O<a, b, c, d, e, f, <1$]. Further, it may also be constituted of an organic insulating material such as polyesters, poly-p-xylylene, polyurethanes, etc. However, in view of the productivity, mass productivity as well as the electrical and environmental stabilities during use, the material constituting the upper layer 205 is desirably $a-Si_aO_{1-a}$, $a-Si_bO_{1-b}$ containing at least one of hydrogen atoms(H) and halogen atoms(X), or $a-Si_cN_{1-c}$, $a-Si_dN_{1-d}$ containing at least one of hydrogen atoms and halogen atoms, $a-Si_eC_{1-e}$ or a—-

$Si_fC_{1-f}$ containing at least one of hydrogen atoms and halogen atoms.

Among these materials, $a-Si_3C_{1-e}$ and $a-Si_fC_{1-f}$ containing at least one of hydrogen atoms and halogen atoms are most preferred. In addition to those mentioned above, other materials suitable for constituting the upper layer 205 may include amorphous materials containing at least two kinds of atoms selected from C, N and O together with silicon atoms as matrix, and also containing at least one of halogen atoms and hydrogen atoms. As the halogen atom, there may be mentioned F, Cl, Br, etc., but an amorphous material containing F is effective with respect to thermal stability.

The upper layer 205 may be formed according to the glow discharge method, the sputtering method, the ion implantation method, the iron plating method, the electron beam method, or the like.

Among the methods for formation of the upper layer 205, the glow discharge method or the reaction sputtering method may preferably be adopted for the advantages of easy control of the conditions for preparation of a photoconductive member having desirable characteristics as well as easy incorporation of other necessary atoms such as oxygen atoms, nitrogen atoms, carbon atoms or hydrogen atoms and halogen atoms together with silicon atoms into the upper layer prepared.

For example, when the upper layer 205 is formed according to the glow discharge method, the starting gases for formation of the upper layer, which may be admixed, if necessary, with a diluting gas at a desired mixing ratio, are introduced into the deposition chamber for vacuum deposition, and the gas introduced is converted to a gas plasma by excitation of glow discharge in the chamber thereby to deposit the substance for forming the upper layer 205 on the photoconductive layer 203.

As the starting materials which can be the starting gases for formation of the upper layer in the present invention, there may be employed most of the substances having at least one of Si, C, N, O, H and X as constituent atoms, which are gaseous or gasified from gasifiable substances.

The substances effectively used as the starting materials for formation of the upper layer 205 in the present invention may include silicon hydride gases constituted of Si and H atoms such as silanes, as exemplified by $SiH_4$, $Si_2H_6$, $Si_3H_8$, $Si_4H_{10}$, etc., hydrocarbons constituted of C and H atoms such as saturated hydrocarbons having 1 to 5 carbon atoms, ethylenic hydrocarbons having 2 to 5 carbon atoms or acetylenic hydrocarbons having 2 to 4 carbon atoms. More specifically, typical examples are saturated hydrocarbons such as methane($CH_4$), ethane($C_2H_6$), propane ($C_3H_8$), n-butane($n-C_4H_{10}$), pentane($C_5H_{12}$) and the like; ethylenic hydrocarbons such as ethylene($C_2H_4$), propylene($C_3H_6$), butene-1($C_4H_8$), butene-2($C_4H_8$), isobutylene($C_4H_8$), pentene($C_5H_{10}$) and the like; and acetylenic hydrocarbons such as acetylene($C_2H_2$), methylacetylene($C_3H_4$), butyne($C_4H_6$) and the like.

Typical examples of the starting gas having Si, C and H as constituent atoms are alkyl silanes such as $Si(CH_3)_4$, $Si(C_2H_5)_4$ and the like. In addition to these starting gases, $H_2$ can of course be effectively used as the starting gas for incorporation of hydrogen atoms(H).

The starting materials for incorporation of halogen atoms(X) may include single substances of halogen, hydrogen halides, interhalogen compounds, silicon halides, halogen substituted silicon hydrides, etc. More specifically, there may be included simple substances of halogen such as halogenic gases of fluorine, chlorine, bromine and iodine; hydrogen halides such as HF, HI, HCl, HBr, etc.; interhalogen compounds such as BrF, ClF, $ClF_3$, $ClF_5$, $BrF_5$, $BrF_3$, $IF_7$, $IF_5$, ICl, IBr, etc.; silicon halides such as $SiF_4$, $Si_2F_6$, $SiCl_4$, $SiCl_3Br$, $SiCl_2Br_2$, $SiClBr_3$, $SiCl_3I$, $SiBr_4$, etc.; halogen substituted silicon hydrides such as $SiH_2F_2$, $SiH_2Cl_2$, $SiHCl_3$, $SiH_3Cl$, $SiH_3Br$, $SiH_2Br_2$, $SiHBr_3$, and the like.

In addition to those mentioned above, as the starting materials useful for formation of the upper layer, there are halogen substituted paraffinic hydrocarbons such as $CCl_4$, $CHF_3$, $CH_2F_2$, $CH_3F$, $CH_3Cl$, $CH_3Br$, $CH_3I$, $C_2H_5Cl$, etc.; fluorinated sulfur compounds such as $SF_4$, $SF_6$, etc.; and halogen containing alkyl silane such as $SiCl(CH_3)_3$, $SiCl_2(CH_3)_2$, $SiCl_3CH_3$, etc.

As the starting materials for incorporation of nitrogen atoms, there may be mentioned, for example, nitrogen($N_2$), ammonia($NH_3$), hydrazine($H_2NNH_2$), hydrogen azide($HN_3$), ammonium azide($NH_4N_3$), and the like.

As the starting materials for incorporation of oxygen atoms, there may be mentioned oxygen($O_2$), ozone($O_3$), disiloxane($H_3SiOSiH_3$), trisiloxane($H_3SiOSiH_2OSiH_3$), and the like.

Other than these starting materials for formation of the upper layer, there may also be mentioned, for example, carbon monoxide(CO), carbon dioxide($CO_2$), dinitrogen oxide($N_2O$), dinitrogen trioxide($N_2O_3$), dinitrogen tetraoxide($N_2O_4$), dinitrogen pentoxide($N_2O_5$), nitrogen trioxide($NO_3$), and the like.

These starting materials for formation of the upper layer are suitably selected upon forming the layer so that the required atoms may be contained as constituent atoms in the upper layer formed. For example, when using the glow discharged method, there may be employed a single gas such as $Si(CH_3)_4$, $SiCl_2(CH_3)_2$, and the like or a gas mixture such as $SiH_4$—$N_2O$ system, $SiH_4$—$O_2$—(—Ar) system, $SiH_4$—$NO_2$ system, $SiH_4$—$O_2$—$N_2$ system, $SiCl_4$—NO—$H_2$ system, $SiCl_4$—$NH_4$ system, $SiH_4$—$N_2$ system, $SiH_4$—$NH_3$—NO system, $Si(CH_3)_4$—$SiH_4$ system, $SiCl_2(CH_3)_2$—$SiH_4$ system, etc. as the starting material for formation of the upper layer 205.

Alternatively, the upper layer 205 can be formed according to the sputtering method by using a single crystalline or polycrystalline Si wafer and C wafer, $SiO_2$ wafer or $Si_3N_4$ wafer, or a wafer containing Si and C, $SiO_2$ or $Si_3N_4$ mixed therein as target, and effecting sputtering of these in various atmospheres so that desired upper layer may be formed. For example, when Si wafer is used as target, the starting gas for incorporation of C, N, O, or H, X (if necessary) for example $H_2$ and $N_2$ or $H_2$ and $NH_3$, or $NH_3$, $H_2$ and $C_2H_6$, and the like which may optionally be diluted with a diluting gas such as Ar and the like, if desired, are introduced into the deposition chamber for sputter to form a gas plasma of these gases and effect sputtering of the aforesaid Si wafer.

As other methods, by use of separate targets of Si and C, $SiO_2$ or $Si_3N_4$ or, one sheet of a mixture of Si and C, $SiO_2$ or $Si_3N_4$, sputtering can be effected in a gas atmosphere for sputter.

In this case, when hydrogen atoms(H) or/and halogen atoms (X) are to be contained in the upper layer formed, the aforesaid starting material gases for incorporation of hydrogen atoms(H) or/and halogen atoms may be introduced into the deposition chamber upon carrying out the sputtering.

When the photoconductive member 200 is used by irradiation of electromagnetic waves to which the photoconductive layer 203 is sensitive on the side of the upper layer 205, selection of the material constituting the upper layer 205 and determination of its layer thickness are conducted carefully so that a sufficient amount of the electromagnetic waves irradiated may reach the photoconductive layer 203 to cause generation of photocarriers with good efficiency.

The layer thickness of the upper layer 205 may suitably be determined as desirable, depending on the materials used for constitution of the layer and the conditions for formation of the layer, so that the function as described above may be exhibited to the full extent.

The layer thickness of the upper layer in the present invention may generally be 30 to 1000 Å, preferably 50 to 600 Å.

When a certain kind of electrophotographic process is adopted in using the photoconductive member of the present invention as an image forming member for electrophotography, it is necessary to provide further a surface coating layer on the free surface of the photoconductive member having the layer structure as shown in FIG. 1 or FIG. 2.

The surface coating layer in this case is required to be electrically insulating and have a sufficient ability to retain electrostatic charges when subjected to charging treatment and a thickness of a certain value or more, when an electrophotographic process such as NP system as disclosed in U.S. Pat. Nos. 3,666,363 and No. 3,734,609 is to be applied. In contrast, when an electrophotographic process such as Carlson process is to be applied, the thickness of the surface coating layer is required to be very thin, since the potential at the light portion after electrostatic image formation is desirably very small. The surface coating layer is formed so as to satisfy the desired electrical characteristics. Further, in formation of the surface coating layer, care is taken to give no deleterious effect on chemical and physical properties of the photoconductive layer or the upper layer, while paying also due considerations as to electrical contactness and adhesion with the photoconductive or the upper layer, and moreover as to the humidity resistance, abrasion resistance, adaptability for cleaning, etc. of the coating layer.

Typical examples of the materials effectively used for formation of the surface coating layer may include organic insulating materials such as polyethylene terephthalate, polycarbonates, polypropylene, polyvinyl chloride, polyvinylidene chloride, polyvinyl alcohols, polystyrene, polyamides, polytetrafluoroethylene, polytrifluorochloroethylene, polyvinyl fluoride, polyvinylidene fluoride, hexafluoropropylene-tetrafluoroethylene copolymer, trifluoroethylene-vinylidene fluoride copolymer, polybutene, polyvinyl butyrals, polyurethanes, poly-p-xylylene, and inorganic insulating materials such as silicon nitride, silicon oxide, etc. Among them, a synthetic resin or a cellulose derivative may be formed into a film and laminated on the photoconductive layer or the upper layer. Alternatively, coating solution of such a material may be coated on the photoconductive layer or the upper layer to accomplish layer formation. The layer thickness of the surface coating layer may suitably be determined depending on the desired characteristics, but generally in the range from about 0.5 to 70μ. In particular, when the surface coating layer is required to have a function as a protective layer, it is made to have a thickness generally of 10μ or less. On the contrary, when the function of an electrically insulating layer is required, the thickness is made at least 10μ. But the layer thickness value 10μ distinguishing the protective layer from the insulating layer is not critical, but it can vary depending on the materials employed, the electrophotographic process to be applied as well as the structure of the image forming member to be designed.

The surface coating layer may also be provided with a role as a reflection preventive layer, whereby its function can more effectively be enlarged.

The photoconductive member according to the present invention can accomplish its objects effectively to exhibit remarkable effects by being constituted as described above. Its intermediate layer, however, may also be constituted of a mixture of materials in addition to the materials as mentioned above. That is, a material for constituting the upper layer may be added to the aforesaid material for constituting the intermediate layer. For example, an intermediate layer may be formed by incorporating silicon atoms, hydrogen atoms or halogen atoms as constituent atoms together with a metal oxide.

The photoconductive member of this invention designed so as to have a layer constitution as described above can overcome all the problems of prior art as described above, and exhibits very excellent electrical, optical and photoconductive characteristics as well as excellent adaptability to environments.

In particular, when the photoconductive member of the present invention is applied for an image forming member for electrophotography or image pickup devices, it has good charge retentive ability in charging treatment, without influence of residual potential on image formation, and its electrical characteristics can be stable even in a humid atmosphere. Moreover, it has a high sensitivity and a high SN ratio, being remarkably excellent in light resistance fatigue and capability of repeated uses. Further, in case of an image forming member for electrophotography, it is possible to obtain a high quality visible image which is high in density, clear in halftone and high in resolution.

A photoconductive member having a layer constitution of prior art cannot be applied for an image forming member for electrophotography in either the case of an a-Si:(H,X) with high dark resistance or the case of an a-Si:(H,X) with high photosensitivity, since the former tends to be lowered in photosensitivity, while the latter has a low dark resistance with at most $10^8$ ohm.cm. In contrast, in the photoconductive member according to the present invention, even an a-Si:(H,X) with a relatively low resistivity ($5\times10^9$ ohm.cm or more) can constitute a photoconductive layer, and hence an a-Si:(H,X) having a high sensitivity but a relatively lower resistance can be sufficiently available. Thus, the restrictions with respect to the characteristics of a-Si:(H,X) can be alleviated.

EXAMPLE 1

Figure 3:
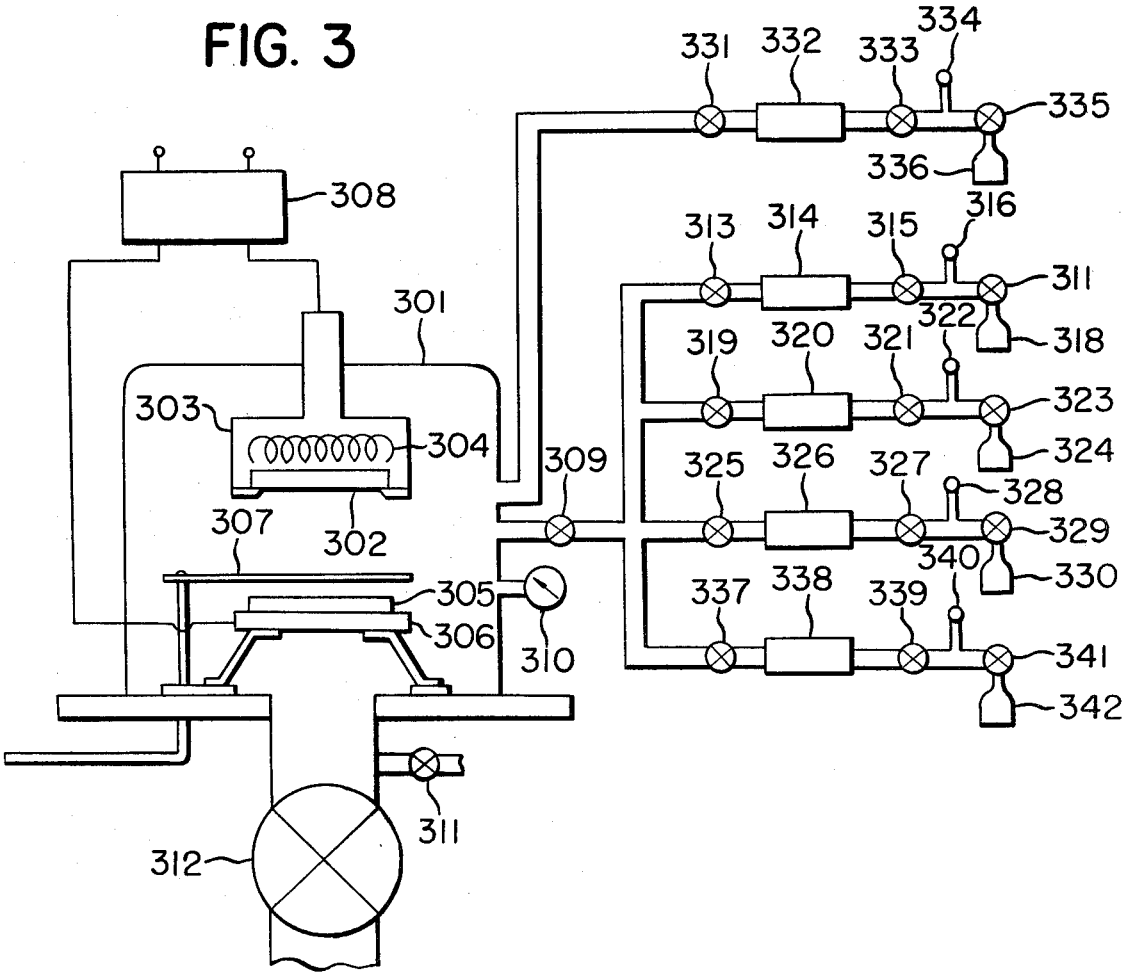
FIGS. 3 and 4 schematic flow charts for illustration of the devices for preparation of the photoconductive members according to the present invention.

Using a device as shown in FIG. 3 placed in a clean room which had been completely shielded, an image forming member for electrophotography was prepared according to the following procedures.

A molybdenum plate (substrate) 302 of 10 cm square having a thickness of 0.5 mm, whose surface had been cleaned, was fixed firmly on a fixing member 303 disposed at a predetermined position in a glow discharging deposition chamber 301. The target 305 was a high purity polycrystalline $TiO_2$ (99.999%). The substrate 302 was heated by a heater 304 within the fixing member 303 with a precision of ±0.5° C. The temperature was measured directly at the backside of the substrate by an alumel-chromel thermocouple. Then, after confirming that all the valves in the system are closed, the main valve 312 was opened fully to evacuate the chamber 301 to about $5\times10^{-6}$ Torr. Then, the input voltage at the heater 304 was changed, while detecting the molybdenum substrate temperature, until it was stabilized constantly at 200° C.

Subsequently, the auxiliary valve 309, and then the outflow valves 313, 319, 331, 337 and inflow valves 315, 321, 333, 339 were fully opened to remove sufficiently the gases in the flowmeters 314, 320, 332, 338 to vacuo. After the auxiliary valve 309 and the valves 313, 319, 331, 337, 315, 321, 333, 339 were closed, respectively, the valve 335 of the bomb 336 containing $O_2$ gas(purity: 99.999%) and the valve 341 of the bomb 342 containing Ar gas(purity: 99.999%) were opened until the reading on the outlet pressure gages 334, 340 were respectively adjusted to 1 kg/cm$^2$, and then the inflow valves 333, 339 were gradually opened thereby to introduce $O_2$ and Ar gases into the flowmeters 332 and 338. Subsequently, the outflow valves 331, 337 were gradually opened, followed by gradual opening of the auxiliary valve 309. The inflow valves 333 and 338 were adjusted so that $O_2$/Ar flow amount ratio was 2:5.

The opening of the auxiliary valve 309 was adjusted, while reading carefully the Pirani gage 310 until the pressure in the chamber 301 became $5\times10^{-4}$ Torr. After the inner pressure in the chamber 301 was stabilized, the main valve 312 was gradually closed to narrow the opening until the indication on the Pirani gage 310 became $1\times10^{-2}$ Torr. After confirming that the gas feeding and the inner pressure were stabilized, the shutter 307 was opened and then the high frequency power source 308 was turned on to input an alternate current of 13.56 MHz between the $TiO_2$ target 305 and the fixing member 303 to generate glow discharge in the chamber 301 to provide an input power of 100 W. The above conditions were maintained for 15 minutes to form an intermediate layer. Then, the high frequency power source 308 was turned off for intermission of glow discharging.

Subsequently, the outflow valves 331, 337 and inflow valves 333, 339 were closed and the main valve 312 fully opened to remove the gas in the chamber 301 until it was evacuated to $5\times10^{-6}$ Torr. Then, the auxiliary valve 309 and the outflow valves 331, 337 were opened fully to effect degassing sufficiently in the flowmeters 332, 338 to vacuo. After closing the auxiliary valve 309 and the valves 331, 337, the valve 317 of the bomb 318 containing $SiH_4$ gas (purity: 99.999%) diluted with $H_2$ to 10 vol. % [hereinafter referred to as $SiH_4(10)/H_2$] and the valve 323 of the bomb 324 containing $B_2H_6$ gas diluted with $H_2$ to 50 vol. ppm [hereinafter referred to as $B_2H_6(50)/H_2$] were respectively opened to adjust the pressure at the outlet pressure gages 316 and 322, respectively, to 1 kg/cm$^2$, whereupon the inflow valves 315, 321 were gradually opened to introduce $SiH_4(10)/H_2$ gas and $B_2H_6(50)H_2$ gas into the flowmeters 314 and 320, respectively. Subsequently, the outflow valves 313 and 319 were gradually opened, followed by opening of the auxiliary valve 309. The inflow valves 315 and 321 were adjusted thereby so that the gas flow amount ratio of $SiH_4(10)/H_2$ to $B_2H_6(50)/H_2$ was 50:1. Then, while carefully reading the Pirani gage 310, the opening of the auxiliary valve 309 was adjusted and it was opened to the extent until the inner pressure in the chamber 301 became $1\times10^{-2}$ Torr. After the inner pressure in the chamber 301 was stabilized, the main valve 312 was gradually closed to narrow its opening until the indication on the Pirani gage 310 became 0.5 Torr.

After the shutter 307 (which was also the electrode) was closed and, confirming that the gas flow amount and the inner pressure were stable, the high frequency power source 308 was turned on to input a high frequency power of 13.56 MHz between the electrode 303 and the shutter 307, thereby generating glow discharge in the chamber 301 to provide an input power of 10 W. After glow discharging was continued for 3 hours to form a photoconductive layer, the heater 304 was turned off with the high frequency power source 308 being also turned off, the substrate was left to cool to 100° C., whereupon the outflow valves 313, 319 and the inflow valves 315, 321 were closed, with the main valve 312 fully opened, thereby to make the inner pressure in the chamber 301 to $10^{-5}$ Torr or less. Then, the main valve 312 was closed and the inner pressure in the chamber 301 was made atmospheric through the leak valve 311, and the substrate having formed respective layers thereon was taken out. In this case, the entire thickness of the layers was about 9μ. The thus prepared image forming member was placed in an experimental device for charging and light-exposure, and corona charging was effected at ⊕6.0 KV for 0.2 sec., followed immediately by irradiation of a light image. The light image was irradiated through a transmission type test chart using a tungsten lamp as light source at a dosage of 1.0 lux. sec.

Immediately thereafter, negatively (⊖) charged developers (containing toner and carrier) were cascaded on the surface of the member to obtain a good toner image on the image forming member. When the toner image on the image forming member was copied on a copying paper by corona charging at ⊕5.0 KV, there was obtained a clear image of high density which was excellent in resolution as well as in gradation reproducibility.

Next, the above image forming member was subjected to corona charging by means of a charging light-exposure experimental device at ⊖5.5 KV for 0.2 sec., followed immediately by image exposure at a dosage of 0.8 lux. sec., and thereafter immediately positively (⊕) charged developer was cascaded on the surface of the member. Then, by copying on a copying paper and fixing, there was obtained a very clear image.

As apparently seen from the above result, in combination with the previous result, the image forming member for electrophotography obtained by the present Example has the characteristics of a both-polarity image forming member having no dependency on the charge polarity.

EXAMPLE 2

The image forming members as shown by Sample Nos. $A_1$ through $A_8$ were prepared under the same conditions and procedures as in Example 1 except that the sputtering time in forming the intermediate layer on the molybdenum substrate was varied as shown below in Table 1, and image formation was effected by placing in entirely the same device as in Example 1 to obtain the results as shown in Table 1.

As apparently seen from the results shown in Table 1, it is necessary to form the intermediate layer to a thickness within the range of from 30 A to 1000 A to achieve the object of the present invention.

TABLE 1

| Sample No. | A1 | A2 | A3 | A4 | A5 | A6 | A7 | A8 |
|---|---|---|---|---|---|---|---|---|
| Time for formation of intermediate layer (min.) | 1 | 3 | 5 | 15 | 30 | 50 | 100 | 120 |
| Image quality | | | | | | | | |
| Charging polarity + | Δ | o | ◎ | ◎ | ◎ | o | Δ | X |
| Charging polarity − | X | Δ | ◎ | ◎ | ◎ | o | Δ | X |

Ranks for evaluation:
◎excellent;
o good;
Δ actually useable;
X actually slightly inferior
Deposition speed of intermediate layer: 10 Å/min.

EXAMPLE 3

According to the same procedures and under the same conditions as in Example 1 except that only $SiH_4(10)/H_2$ was used as the starting gas, an intermediate layer and a photoconductive layer were formed on a molybdenum substrate.

In this case, the entire thickness of the layers formed was about 9μ. When the thus prepared image forming member was subjected to image formation under the same conditions according to the same procedures as in Example 1, the image formed by ⊖corona discharge was better in image quality and very clear, as compared with that formed by ⊕corona discharge. This result shows that the image forming member prepared in this Example is dependent on the charging polarity.

EXAMPLE 4

After an intermediate layer was formed on a molybdenum substrate for 15 minutes under the same conditions according to the same procedures as in Example 1, the deposition chamber was evacuated to $5\times10^{-7}$ Torr, whereupon $SiH_4(10)/H_2$ gas was introduced into the chamber according to the same procedure as in Example 1. Then, under the gas pressure of 1 kg/cm$^2$ (reading on the outlet pressure 328) from the gas bomb 330 of $PH_3$ gas diluted to 25 vol. ppm with $H_2$ [hereinafter referred to as $PH_3(25)/H_2$] through the inflow valve 327, the inflow valve 327 and the outflow valve 325 were controlled to determine the opening of the outflow valve 325 so that the reading on the flow meter 326 may be 1/50 of the flow amount of $SiH_4(10)/H_2$ gas until stabilization of the gas flow.

Subsequently, with the shutter 307 closed, the high frequency power source 308 was turned on again to recommence glow discharge. The input voltage applied was 10 W. Thus, glow discharge was continued for additional 4 hours to form a photoconductive layer on the intermediate layer. The heater 304 and the high frequency power source 308 were turned off and, upon cooling of the substrate to 100° C., the outflow valves 313, 325 and the inflow valves 315, 327 were closed, with full opening of the main valve 312 to evacuate the chamber 301 to $10^{-5}$ Torr or less. Then, the chamber 301 was brought to atmospheric through the leak valve 311 with closing of the main valve 312, and the substrate having formed respective layers was taken out. In this case, the entire thickness of the layers formed was about 11μ.

The thus prepared image forming member was used for forming an image on a copying paper according to the same procedures and under the same conditions as in Example 1. As a result, the image formed by ⊖corona discharge was more excellent in image quality and extremely clear, as compared with that formed by ⊕corona discharge. This result shows that the image forming member obtained in this Example has a dependency on charging polarity.

EXAMPLE 5

After forming an intermediate layer and a photoconductive layer on a molybdenum substrate under the same conditions according to the same procedures as in Example 1, except that the gas flow amount ratio of $SiH_4(10)/H_2$ to $B_2H_6(50)/H_2$ gas was set at 10:1, the substrate was taken out from the deposition chamber 301.

The thus prepared image forming member was used for forming an image on a copying paper according to the same procedures and under the same conditions as in Example 1. As a result, the image formed by ⊕corona discharge was more excellent in image quality and extremely clear, as compared with that formed by ⊖corona discharge. This result shows that the image forming member obtained in this Example has a dependency on charging polarity, which dependency, however, was opposite to that in the image forming members obtained in Examples 3 and 4.

EXAMPLE 6

The $PH_3(25)/H_2$ gas bomb 330 was previously replaced with a gas bomb containing $AlCl_3$ gas [purity: 99.999%] diluted with Ar to 10 vol. % [hereinafter referred to as $AlCl_3(10)/Ar$], and a molybdenum substrate was firmly fixed on a fixing member 303 as shown in FIG. 3, similarly as in Example 1.

Then, after confirming that all the valves in the system were closed, the main valve 312 was opened, and evacuation was effected once to $5\times10^{-7}$ Torr. Then, the input voltage at the heater 308 was changed, while detecting the molybdenum substrate temperature, until it was stabilized constantly at 200° C.

This step was followed by full opening of the auxiliary valve 309, the outflow valves 313, 319, 331 and the inflow valves 315, 321, 333 to remove sufficiently the gases in the flowmeters 314, 320, 332 to vacuo. Thereafter, the valves 315, 321, 333, 313, 331 and the auxiliary valve 309 were closed, and the valve 329 of the $AlCl_3(10)/Ar$ gas bomb 330 and the valve of the bomb 336 containing $O_2$ gas (purity: 99.999%) was opened until the reading on the outlet pressure gages 328, 334 was respectively adjusted to 1 kg/cm$^2$, and then the inflow valves 327, 333 were gradually opened thereby to introduce $AlCl_3(10)/Ar$ gas and $O_2$ gas into the deposition chamber 301. Then, the outflow valves 325, 331 were gradually opened, followed by gradual opening of the auxiliary valve 309. The inflow valves 327 and 333 were adjusted thereby so that the flow amount ratio of $AlCl_3(10)/Ar$ gas to $O_2$ gas was 1:1. The opening of the auxiliary valve 309 was adjusted, while reading carefully the Pirani gage 310 until the pressure in the chamber 301 became $1\times10^{-2}$ Torr. After the inner pressure in the chamber 301 was stabilized, the main valve 312 was gradually closed to narrow the opening until the indication on the Pirani gage became 0.5 Torr. After confirming that the gas feeding and the inner pressure were stabilized, the shutter 307 (which was also the electrode) was closed and then the high frequency power source 308 was turned on to input an alternate current of 13.56 MHz between the fixing member 303 and the shutter 307 to generate glow discharge in the chamber 301 to provide an input power of 30 W. Under these conditions, discharging was continued for 5 minutes to form an intermediate layer. Then, with the high frequency power source 308 turned off for intermission of glow discharging, the outflow valve 325, 331 were closed.

Then, under the same conditions according to the same procedure as in Example 1, a photoconductive layer was formed on the intermediate layer.

The thus prepared image forming member was placed in an experimental device for charging and light-exposure, and corona charging was effected at ⊕6.0 KV for 0.2 sec., followed immediately by irradiation of a light image. The light image was irradiated through a transmission type test chart using a tungsten lamp as light source at a dosage of 0.8 lux. sec.

Immediately thereafter, negatively (⊖) charged developers (containing toner and carrier) were cascaded on the surface of the member to obtain a good toner image on the image forming member. When the toner image on the image forming member was copied on a copying paper by corona charging at ⊕5.0 KV, there was obtained a clear image of high density which was excellent in resolution as well as in graduation reproducibility.

Next, the above image forming member was subjected to corona charging by means of a charging light-exposure experimental device at ⊖5.5 KV for 0.2 sec., followed immediately by image exposure at a dosage of 0.8 lux. sec., and thereafter immediately positively (⊕) charged developer was cascaded on the surface of the member. Then, by copying on a copying paper and fixing, there was obtained a very clear image.

As apparently seen from the above result, in combination with the previous result, the image forming member for electrophotography has the characteristics of a both-polarity image forming member having no dependency on the charged polarity.

EXAMPLE 7

Four sheets of image forming members were prepared similarly as in Example 1, except that the targets 305 employed, gas atmospheres employed, flow amount ratios, and layer thickness of intermediate layers during formation of intermediate layer were changed as shown in Table 2.

When each of the image forming members was tested for image formation by copying similarly as in Example 1, there was obtained a clear toner image without dependency on the charging polarity.

TABLE 2

| Sample No. | Conditions for preparation of intermediate layer: Target | Gases, Flow amount ratio | Layer thickness (Å) |
|---|---|---|---|
| A9 | $Al_2O_3$ | $O_2$, Ar $O_2$/Ar = 1/10 | 120 |
| A10 | $Ce_2O_3$ | $O_2$, Ar $O_2$/Ar = 2/5 | 100 |
| A11 | MgO | $O_2$, Ar $O_2$/Ar = 2/5 | 100 |

TABLE 2-continued

| Sample No. | Conditions for preparation of intermediate layer: Target | Gases, Flow amount ratio | Layer thickness (Å) |
|---|---|---|---|
| A12 | $MgO \cdot Al_2O_3$ | $O_2$, Ar $O_2$/Ar = 1/10 | 120 |

EXAMPLE 8

After conducting formation of an intermediate layer for 15 minutes on a molybdenum substrate and then formation of a photoconductive layer for 5 hours according to the same procedures under the same conditions as in Example 1, the high frequency power source 308 was turned off for intermission of glow discharge. Under this state, the outflow valves 313, 319 were closed and the outflow valves 331, 337 were opened again with opening of the shutter 307, thus creating the same conditions as in formation of the intermediate layer. Subsequently, the high frequency power source was turned on to renew the glow discharge. The input power was 100 W, which was also the same as in formation of the intermediate layer. Thus, glow discharge was continued for 15 minutes to form an upper layer on the photoconductive layer. Then, the high frequency power source 308 was turned off and the substrate was left to cool. Upon reaching 100° C. of the substrate temperature, the outflow valves 331, 337 and the inflow valves 333, 339 were closed, with full opening of the main valve 312, thereby evacuating the chamber to $10^{-5}$ Torr or less. Then, the main valve 312 was closed to return the chamber 301 to atmospheric through the leak valve 311, and the substrate having formed respective layers thereon was taken out.

The thus prepared image forming member for electrophotography was placed in the same charging light-exposure experimental device as used in Example 1, wherein corona charging was effected at ⊕6.0 KV for 0.2 sec., followed immediately by irradiation of a light image. Irradiation of the light image was effected through a transmission type test chart, using a tungsten lamp as light source, at a dosage of 1.0 lux. sec.

Immediately thereafter, ⊖charged developers (containing toner and carrier) were cascaded on the surface of the member, whereby there was obtained a good toner image on the surface of the member. The toner image on the member was copied on a copying paper by corona discharge at ⊕5.0 KV. As a result, a clear high density image was obtained with excellent resolving power and good gradation reproducibility.

EXAMPLE 9

According to the same procedures under the same conditions as in Example 1, there were prepared 8 samples of image forming members. Then, on each of the photoconductive layers of these samples, an upper layer was formed under various conditions AA to AH indicated in Table 3 to prepare 8 samples having respective upper layers.

In forming the upper layer AA according to the sputtering method, the target 305 was changed to a polycrystalline silicon target having partially laminated a graphite target thereon; while in forming the upper layer E, the polycrystalline silicon target was changed to $Si_3N_4$ target.

In forming the upper layer AB according to the glow discharge method, the $PH_3(25)/H_2$ gas bomb 330 was changed to the bomb containing $C_2H_4$ gas diluted with $H_2$ to 10 vol. % [abridged as $C_2H_4(10)/H_2$]; in forming the upper layer AC, the $PH_3(25)/H_2$ gas bomb 330 to bomb containing $Si(CH_3)_4$ diluted to 10 vol. % with $H_2$ [abridged as $Si(CH_3)_4(10)/H_2$]; in forming the upper layer AD, $SiH_4(10)/H_2$ gas bomb 318 to a bomb of $SiH_4$ containing 10 vol. % of $H_2$ [hereinafter referred to as $SiH_4/H_2(10)$], and the $PH_3(25)/H_2$ gas bomb 330 to $C_2H_4(10)/H_2$ gas bomb; in forming upper layers AF, AG, the $PH_3(25)/H_2$ gas bomb 330 to the $N_2$ gas bomb, and to a bomb containing $NH_3$ diluted to 10 vol. % with $H_2$ [hereinafter referred to as $NH_3(10)/H_2$], respectively. In forming the upper layer AH, the $PH_3(25)/H_2$ gas bomb was changed to the $N_2$ gas bomb, and the $SiH_4(10)/H_2$ gas bomb to a bomb of $SiF_4$ containing 10 vol. % of $H_2$ [abridged as $SiF_4/H_2(10)$].

Each of the thus prepared 8 image forming members having the upper layers AA to AH, respectively, was used for copying a visible image on a copying paper, similiary as in Example 1 whereby there was obtained a very clear toner image free from dependency on the charging polarity.

TABLE 3

Upper layer: Forming Conditions

| Sample No. | Starting gas or Target | Feed gas (or area) ratio | Preparation method | Power (W) | Layer Thickness (Å) |
|---|---|---|---|---|---|
| AA | Polycrystalline Si target, Graphite target, Ar | Si:C (area ratio) = 1:9 | Sputter | 100 | 120 |
| AB | $SiH_4$ (dil. with $H_2$ to 10 vol. %)<br>$C_2H_4$ (dil. with $H_2$ to 10 vol. %) | $SiH_4(10)/H_2$:<br>$C_2H_4(10)/H_2$ = 1:9 | Glow | 3 | 120 |
| AC | $Si(CH_3)_4$ (dil. with $H_2$ to 10 vol. %) | — | Glow | 3 | 120 |
| AD | $SiF_4$ ($H_2$ content: 10 vol. %)<br>$C_2H_4$ (dil. with $H_2$ to 10 vol. %) | $SiF_4/H_2(10)$:<br>$C_2H_4(10)/H_2$ = 1:9 | Glow | 60 | 120 |
| AE | $Si_3N_4$ target<br>$N_2$ (dil. with Ar to 50%) | — | Sputter | 100 | 200 |
| AF | $SiH_4$ (dil. with $H_2$ to 10 vol. %)<br>$N_2$ | $SiH_4(10)/H_2$:<br>$N_2$ = 1:10 | Glow | 3 | 120 |
| AG | $SiH_4$ ($H_2$ content: 10 vol. %)<br>$NH_3$ (dil. with $H_2$ to 10%) | $SiH_4(10)/H_2$:<br>$NH_3(10)/H_2$ = 1:2 | Glow | 3 | 120 |
| AH | $SiF_4$ ($H_2$ content: 10 vol. %); $N_2$ | $SiF_4/H_2(10)$:$N_2$ = 1:90 | Glow | 60 | 120 |

EXAMPLE 10

Figure 4:
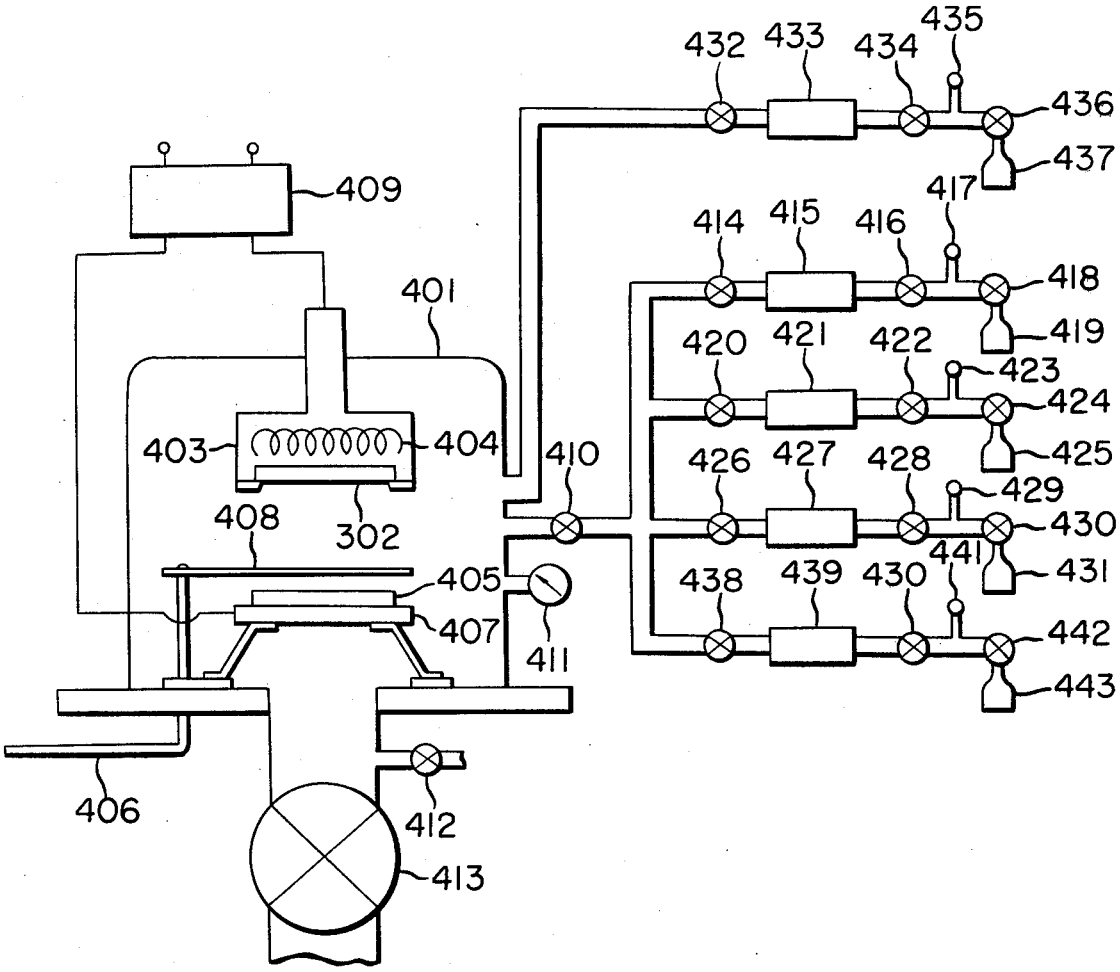

Using a device as shown in FIG. 4 placed in a clean room which had been completely shielded, an image forming member for electrophotography was prepared according to the following procedures.

A molybdenum plate (substrate) 402 of 10 cm square having a thickness of 0.5 mm, whose surface had been cleaned, was fixed firmly on a fixing member 403 disposed at a predetermined position in a glow discharging deposition chamber 401. The target 405 was a high purity polycrystalline $TiO_2$ (99.999%). The substrate 402 was heated by a heater 404 within the supporting member 403 with a precision of ±0.5° C. The temperature was measured directly at the backside of the substrate by an alumel-chromel thermocouple. Then, after confirming that all the valves in the system are closed, the main valve 413 was opened fully to evacuate the chamber 401 once to about $5\times10^{-7}$ Torr. Then, the input voltage at the heater 404 was changed, while detecting the molybdenum substrate temperature, until it was stabilized constantly at 200° C.

Subsequently, the auxiliary valve 410, and then the outflow valves 414, 420, 432 were opened to remove sufficiently the gases in the flowmeters 415, 421, 433, to vacuo. Then, the auxiliary valve 410 and the outflow valves 414, 420, 432, were closed. The valve 436 of the bomb 437 of Ar gas (Purity: 99.999%) containing 40 vol. % of $O_2$ [hereinafter referred to as $O_2(40)Ar$] was opened until the reading on the outlet pressure gage 435 was adjusted to 1 kg/cm$^2$, and then the inflow valve 432 was gradually opened thereby to introduce $O_2(40)/Ar$ gas into the chamber 401. Subsequently, the outflow valve 432 was gradually opened, until the indication on the Pirani gage 411 became $5\times10^{-4}$ Torr. After the flow amount under this state was stabilized, the main valve 413 was gradually closed to narrow the opening until the inner pressure in the chamber became $1\times10^{-2}$ Torr. After confirming that the flowmeter 433 was stabilized, with the shutter 408 being opened by operation of the shutter rod 406, the high frequency power source 409 was turned on to input an alternate current of 13.56 MHz, 100 W between the target 405 and the fixing member 403. Under these conditions, a layer was formed while taking matching so as to continue stable discharging. The above conditions were maintained for 15 minutes to form an intermediate layer of 150 A thickness. Then, the high frequency power source 409 was turned off for intermission of glow discharging. Subsequently, the outflow valve 432 and the valve 436 were closed and the main valve 413 fully opened to remove the gas in the chamber 401 until it was evacuated to $5\times10^{-7}$ Torr.

Then, the auxiliary valve 410, then, the outflow valve 432 and the inflow valve 434 were opened fully to effect degassing sufficiently in the flowmeters 433 to vacuo. After closing the auxiliary valve 410 and the outflow valve 432, the valve 418 of the bomb 419 of $SiF_4$ gas (purity: 99.999%) containing 10 vol. % of $H_2$ [hereinafter referred to as $SiF_4/H_2(10)$] and the valve 424 of the bomb 425 containing $B_2H_6$ gas diluted with $H_2$ to 500 vol. ppm [hereinafter referred to as $B_2H_6(500)/H_2$]

were respectively opened to adjust the pressures at the outlet pressure gages 417 and 423, respectively, to 1 kg/cm$^2$, whereupon the inflow valves 416, 422 were gradually opened to introduce $SiF_4/H_2(10)$ gas and $B_2H_6(500)/H_2$ gas into the flowmeters 415 and 421, respectively. Subsequently, the outflow valves 414 and 420 were gradually opened, followed by gradual opening of the auxiliary valve 410. The inflow valves 315 and 321 were adjusted thereby so that the gas flow amount ratio of $SiF_4/H_2(10)$ to $B_2H_6(500)/H_2$ was 70:1. Then, while carefully reading the Pirani gage 411, the opening of the auxiliary valve 410 was adjusted and it was opened to the extent until the inner pressure in the chamber 401 became $1\times10^{-2}$ Torr. After the inner pressure in the chamber 401 was stabilized, the main valve 413 was gradually closed to narrow its opening until the indication on the Pirani gage 411 became 0.5 Torr. After confirming that the gas flow amount and the inner pressure were stable, the shutter 408 (which was also the electrode) was closed by operation of the shutter rod 406 and the high frequency power source 409 was turned on to input a high frequency power of 13.56 MHz between the electrode 403 and the shutter 408, thereby generating glow discharge in the chamber 401 to provide an input power of 60 W. After glow discharging was continued for 3 hours to form a photoconductive layer, the heater 404 was turned off with the high frequency power source 409 being also turned off, the substrate was left to cool to 100° C., whereupon the outflow valves 414, 420 and the inflow valves 416, 422 were closed, with the main valve 413 fully opened, thereby to make the inner pressure in the chamber 401 to $10^{-5}$ Torr or less. Then, the main valve 413 was closed and the inner pressure in the chamber 401 was made atmospheric through the leak valve 412, and the substrate having formed respective layers thereon was taken out. In this case, the entire thickness of the layers was about 9$\mu$. The thus prepared image forming member was placed in an experimental device for charging and light-exposure, and corona charging was effected at ⊕6.0 KV for 0.2 sec., followed immediately by irradiation of a light image. The light image was irradiated through a transmission type test chart using a tungsten lamp as light source at a dosage of 0.8 lux. sec.

Immediately thereafter, negatively (⊖) charged developers (containing toner and carrier) were cascaded on the surface of the member to obtain a good toner image on the image forming member. When the toner image on the image forming member was copied on a copying paper by corona charging at ⊕5.0 KV, there was obtained a clear image of high density which was excellent in resolution as well as in gradation reproducibility.

Next, the above image forming member was subjected to corona charging by means of a charging light-exposure experimental device at ⊖5.5 KV for 0.2 sec., followed immediately by image exposure to light at a dosage of 0.8 lux. sec., and thereafter immediately positively (⊕) charged developer was cascaded on the surface of the member. Then, by copying on a copying paper and fixing, there was obtained a very clear image.

As apparently seen from the above result, in combination with the previous result, the image forming member for electrophotography obtained by this Example has the characteristics of a both-polarity image forming member having no dependency on the charged polarity.

EXAMPLE 11

The image forming members as shown by Sample Nos. B1 through B8 were prepared under the same conditions and procedures as in Example 10, except that the sputtering time in forming the intermediate layer on the molybdenum substrate was varied as shown below in Table 4, and image formation was effected by placing in entirely the same device as in Example 10 to obtain the results as shown in Table 4.

As apparently seen from the results shown in Table 4, it is necessary to form the intermediate layer to a thickness within the range of from 30 A to 1000 A to achieve the object of the present invention.

TABLE 4

| Sample No. | B1 | B2 | B3 | B4 | B5 | B6 | B7 | B8 |
|---|---|---|---|---|---|---|---|---|
| Time for formation of intermediate layer (min.) | 1 | 3 | 5 | 15 | 30 | 50 | 100 | 120 |
| Image quality | | | | | | | | |
| Charging polarity + | Δ | ○ | ◎ | ◎ | ◎ | ○ | Δ | X |
| Charging polarity − | X | Δ | ◎ | ◎ | ◎ | ○ | Δ | X |

Ranks for evaluation:
◎ excellent;
○ good;
Δ actually useable;
X actually slightly inferior
Deposition speed of intermediate layer: 10 Å/min.

EXAMPLE 12

According to the same procedures and under the same conditions as in Example 10, except that only $SiF_4/H_2(10)$ gas was used as the starting gas an intermediate layer and a photoconductive layer were formed on a molybdenum substrate.

In this case, the entire thickness of the layers formed was about 15$\mu$. When the thus prepared image forming member was subjected to image formation uner the same conditions according to the same procedures as in Example 10, the image formed by ⊖ corona discharge was better in image quality and very clear, as compared with that formed by ⊕ corona discharge. This result shows that the image forming member prepared in this Example is dependent on the charging polarity.

EXAMPLE 13

After an intermediate layer was formed on a molybdenum substrate for 15 minutes under the same conditions according to the same procedures as in Example 10, the high frequency power source 409 was turned off for intermission of glow discharge, and the outflow valve 432 was closed. Then, under the gas pressure of 1 kg/cm$^2$ (reading on the outlet pressure gages 417 and 429, respectively from the $SiF_4/H_2(10)$ gas bomb 419 and the gas bomb 431 containing $PF_5$ gas diluted to 250 vol. ppm with $H_2$ [hereinafter referred to as $PF_5(250)/H_2$] through the valves 418, 430, the inflow valves 416, 428 were opened to permit $SiF_4/H_2(10)$ and $PF_5(250)/H_2$ gases to flow into the flowmeters 415, 427, and the outflow valves 414, 426 were controlled to determine the openings of the outflow valves 414, 426 so that the reading on the flow meter 427 may be 1/60 of the flow amount of $SiF_4/H_2(10)$ gas until stabilization of the gas flow.

Subsequently, the high frequency power source 409 was turned on again to recommence glow discharge.

The input voltage applied was increased higher than in formation of the intermediate layer to 60 W. Thus, glow discharge was continued for additional 4 hours to form a photoconductive layer on the intermediate layer. The heater 404 and the high frequency power source 409 were turned off and, upon cooling of the substrate to 100° C., the outflow valves 414, 426 and the inflow valves 416, 428 were closed, with full opening of the main valve 413 to evacuate the chamber 401 to $10^{-5}$ Torr or less. Then, the chamber 410 was brought to atmospheric through the leak valve 412 with closing of the main valve 413, and the substrate having formed respective layer thereon was taken out. In this case, the entire thickness of the layers formed was about 11μ.

The thus prepared image forming member was used for forming an image on a copying paper according to the same procedures and under the same conditions as in Example 10. As a result, the image formed by ⊖ corona discharge was more excellent in image quality and extremely clear, as compared with that formed by ⊕ corona discharge. This result shows that the image forming member obtained in this Example has a dependency on charging polarity.

EXAMPLE 14

After forming an intermediate layer for 15 minutes on a molybdenum substrate and forming a photoconductive layer on the intermediate layer under the same conditions according to the same procedures as in Example 10, except that the gas flow amount ratio of $SiF_4/H_2(10)$ gas to $B_2H_6(500)/H_2$ gas was set at 15:1. The thus prepared image forming member was used for forming an image on a copying paper according to the same procedures and under the same conditions as in Example 10. As a result, the image formed by ⊕ corona discharge was more excellent in image quality and extremely clear, as compared with that formed by ⊖ corona discharge. This result shows that the image forming member obtained in this Example has a dependency on charging polarity, which dependency, however, was opposite to that in the image forming members obtained in Examples 12 and 13.

EXAMPLE 15

The $PF_5(250)/H_2$ gas bomb 431 was previously replaced with a gas bomb containing $AlCl_3$ gas [purity: 99.999%] diluted with Ar to 10 vol.% [hereinafter referred to as $AlCl_3(10)/Ar$], and a molybdenum substrate was firmly fixed on a fixing member 403 as shown in FIG. 4, similarly as in Example 10.

Then, the glow discharge deposition chamber 401 was evacuated to $5\times10^{-6}$ Torr. and the substrate temperature was maintained constantly at 200° C. This step was followed by full opening of the auxiliary valve 410, the outflow valves 414, 420, 426, 432 and the inflow valves 416, 422, 428, 434, to remove sufficiently the gases in the flowmeters 415, 421, 427, 433 to vacuo. After closing the auxiliary valve 410 and the valves 414, 420, 426, 432, 416, 422, 428, 434, the valve 430 of the $AlCl_3(10)/Ar$ gas bomb 431 and the valve 436 of the bomb 437 containing $O_2(40)/Ar$ gas were opened until the reading on the outlet pressure gage 435 was adjusted to 1 kg/cm$^2$, and then the inflow valves 428, 434 were gradually opened thereby to introduce $AlCl_3(10)/Ar$ gas and $O_2(40)/Ar$ gases into the flowmeters 427, 433, respectively. Then, the outflow valves 426, 432 were gradually opened, followed by gradual opening of the auxiliary valve 410. The inflow valves 428 and 434 were adjusted thereby so that the flow amount ratio of $AlCl_3(10)/Ar$ gas to $O_2(40)/Ar$ gas was 1:2. The opening of the auxiliary valve 410 was adjusted, while reading carefully the Pirani gage 411 until the pressure in the chamber 401 became $1\times10^{-2}$ Torr. After the inner pressure in the chamber 401 was stabilized, the main valve 413 was gradually closed to narrow the opening until the indication on the Pirani gage 411 became 0.5 Torr. After confirming that the gas flow amount and the inner pressure were stabilized, the shutter 408 (which was also the electrode) was closed and then the high frequency power source 409 was turned on to input a high frequency current of 13.56 MHz between the fixing member 303 and the shutter 307 to generate glow discharge in the chamber 401 at the coil portion (upper part of chamber) to provide an input power of 30 W. Under these conditions, discharging was continued for 5 minutes to form an intermediate layer. Then, with the high frequency power source 409 turned off for intermission of glow discharging, the outflow valves 426, 432 and the inflow valves 428 and 434 were closed.

Then, under the same conditions according to the same procedures as in Example 10, a photoconductive layer was formed on the intermediate layer. In this case, the entire thickness of the layers formed was about 9μ. The thus prepared image forming member was placed in an experimental device for charging and light-exposure, and corona charging was effected at ⊕6.0 KV for 0.2 sec., followed immediately by irradiation of a light image. The light image was irradiated through a transmission type test chart using a tungsten lamp as light source at a dosage of 1.0 lux. sec.

Immediately thereafter, negatively (⊖) charged developers (containing toner and carrier) were cascaded on the surface of the member to obtain a good toner image on the image forming member. When the toner image on the image forming member was copied on a copying paper by corona charging at ⊕5.0 KV, there was obtained a clear image of high density which was excellent in resolution as well as in gradation reproducibility.

When corona charging polarity was changed to ⊖ and the polarity of the developer to ⊕, there was also obtained a clear and good image similarly as in Example 10.

EXAMPLE 16

Four sheets of image forming members were prepared similarly as in Example 10, except that the targets 405 employed, layer thicknesses of intermediate layers during formation of intermediate layers were changed as shown in Table 5.

When each of the image forming members was tested for image formation by copying similarly as in Example 1, there was obtained a clear toner image without dependency on the charging polarity.

TABLE 5

| | Conditions for preparation of intermediate layer | |
|---|---|---|
| Sample No. | Target | Layer thickness (Å) |
| B9 | $Al_2O_3$ | 80 |
| B10 | $Ce_2O_3$ | 100 |
| B11 | MgO | 100 |
| B12 | $MgO.Al_2O_3$ | 80 |

EXAMPLE 17

The $SiF_4/H_2(10)$ gas bomb 418 was previously replaced with $SiF_4$ (purity: 99.999%) diluted to 5 vol.% with Ar [hereinafter referred to as $SiF_4(5)/Ar$]. After an intermediate layer was provided on a molybdenum substrate in a similar way to in Example 10, followed by evacuation of the chamber 401, the main valve 413 was closed with opening of the leak valve 412 to leak the deposition chamber to atmospheric. Under this state, the $TiO_2$ target was replaced with a high purity polycrystalline silicon target 405. Then, with closing of the leak valve 412, the chamber was evacuated to $5\times10^{-7}$ Torr, and the auxiliary valve 410 and the outflow valve 432 were opened to degass sufficiently the flowmeter 433, followed by closing of the outflow valve 432 and the auxiliary valve 410.

The substrate 402 was again kept at 200° C. by inputing the power source to the heater, and the outlet pressure was adjusted to 1 kg/cm$^2$ by means of the outlet pressure gage 417 by opening the valve 418 of the $SiF_4(5)/Ar$ bomb 419. Subsequently the inflow valve 416 was gradually opened to introduce the $SiF_4(5)/Ar$ gas into the flowmeter 415, followed by gradual opening to the outflow valve 414 and further by opening of the auxiliary valve 410.

While detecting the inner pressure in the chamber 401 by the pirani gage 411, the outflow valve 414 was adjusted to fill the gass to $5\times10^{-4}$ Torr. After the flow amount was stabilized under this state, the main valve 413 was gradually closed to narrow its opening until the inner pressure bacame $1\times10^{-2}$ Torr. Confirming that the flowmeter 415 was stabilized and also that the shutter 408 was opened, the high frequency power 409 was turned on to input an alternate current power of 13.56 MHz, 100 W between the target 405 and the fixing member 403. A photoconductive layer was formed, while taking matching so as to continue stable discharging under these conditions. After discharging was thus continued for 3 hours, the high frequency power source 409 was turned off, with the power source for the heater 404 being also turned off. On reaching 100° C. of the substrate temperature, the outflow valve 414 and the auxiliary valve 410 were closed and the main valve 413 was opened fully to draw out the gas in the chamber. Then, the main valve 413 was closed with opening of the leak valve 412 to leak the deposition chamber 401 to atmospheric, whereupon the substrate was taken out.

The thus prepared image forming member was used for forming the image on a copying paper according to the same procedures under the same conditions as in Example 10, whereby the image formed by ⊖ corona discharge was more excellent and clear, as compared with that formed by ⊕ corona discharge. From this result, the image forming member prepared in this Example was recognized to have a dependency on the charging polarity.

EXAMPLE 18

After conducting formation of an intermediate layer for 15 minutes on a molybdenum substrate and then formation of a photoconductive layer for 5 hours on the intermediate layer according to the same procedures under the same conditions as in Example 10, the high frequency power source 409 was turned off for intermission of glow discharge. Under this state, the outflow valves 414, 426 were closed and the outflow valve 432 was opened again with opening of the shutter 408, thus creating the same conditions as in formation of the intermediate layer. Subsequently, the high frequency power source was turned on to recommence glow discharge. The input power was 100 W, which was also the same as in formation of the intermediate layer. Thus, glow discharge was continued for 20 minutes to form an upper layer on the photoconductive layer. Then, the high frequency power source 409 was turned off and the substrate was left to cool. Upon reaching 100° C. of the substrate temperature, the outflow valve 432 and the inflow valves 416, 422, 434 were closed, with full opening of the main valve 413 thereby evacuating the chamber to less than $10^{-5}$ Torr. Then, the main valve 413 was closed to return the chamber 401 to atmospheric through the leak valve 412 and the substrate having formed respective layers thereon was taken out.

The thus prepared image forming member was subjected to toner image formation in a similar way to in Example 10, whereby there was obtained an image excellent in resolution, gradation as well as image density either by a combination of ⊖6 KV corona charging with ⊕ charged developer or by a combination of ⊕6 KV corona charging with ⊖ charged developer.

EXAMPLE 19

There were prepared ten samples of sheets, each having provided on a molybdenum substrate an intermediate layer for 15 minutes and a photoconductive layer for 5 hours according to the same procedures and under the same conditions as in Example 10, and the upper layers as indicated in Table 6 were formed, respectively, on the photoconductive layers of these sheets.

In Samples BA, BB and BC, the upper layers were formed according to the same procedures as in Example 18 except for the following conditions.

In Sample BA, the $PF_5(250)/H_2$ gas bomb was previously changed to the $C_2H_4$ gas bomb diluted to 10 vol.% with $H_2[C_2H_4(10)/H_2]$ and the flow amount gas ratio of $SiH_4$ (purity: 99.999%) diluted to 10 vol.% with $H_2$[hereinafter referred to as $SiH_4(10)/H_2$] from the bomb 443 to $C_2H_4(10)/H_2$ gas was 1:9. In Sample BB, the $PF_5(250)/H_2$ gas bomb 431 was previously changed to a high purity $N_2$ gas (99.999%), and the flow amount ratio of $SiH_4(10)/H_2$ to $N_2$ was 1:10. In Sample BC, the $PF_5(250)/H_2$ gas bomb 431 was changed previously to gas bomb containing the $NH_3$ diluted to 10 vol.% with $H_2[NH_3(10)/H_2]$, and the gas flow amount ratio of $SiH_4(10)/H_2$ to $NH_3(10)/H_2$ was 1:2.

In Samples BD, BE and BF, the upper layers were formed according to the same procedures as in Example 18 except for the following conditions.

In Sample BD, the $PF_5(250)/H_2$ gas bomb 431 was changed to the $C_2H_4(10)/H_2$ gas bomb, and the gas flow amount ratio of $C_2H_4(10)/H_2$ to $SiF_4/H_2(10)$ was 1:9. In Sample BE, the $PF_5(250)/H_2$ gas bomb 431 was changed previously to the gas bomb containing $NH_3$ diluted to 10 vol.% with $H_2[NH_3(10)/H_2]$ and the gas flow amount ratio of $SiF_4/H_2(10)$ to $NH_3(10)/H_2$ was 1:20. In Sample BF, the $PF_5(250)/H_2$ gas bomb 431 was changed to the high purity $N_2$ gas bomb (purity: 99.999%) and the gas flow amount ratio of $SiF_4/H_2(10)$ to $N_2$ was 1:50.

Further, in Sample BG, the $PF_5(250)/H_2$ gas bomb 431 was previously changed to the gas bomb containing $Si(CH_3)_4$ gas diluted to 10 vol.% with $H_2[Si(CH_3)_4(10)/H_2]$, and after formation of a photoconductive layer, the outflow valves 414, 420 were closed, with full opening of the main valve 413 to evacuate once the chamber to $5\times10^{-6}$ Torr. Then, $Si(CH_3)_3(10)/H_2$ gas was introduced into the chamber through the inflow valve 428 and the outflow valve 426, and the upper layer was formed according to the same procedures as in Example 18.

In Samples BH and BI, the targets were changed previously to polycrystalline Si(purity: 99.999%) target and $Si_3N_4$ target, respectively, and further the $PF_5(250)/H_2$ gas bomb 431 was changed to the bomb of $N_2$ diluted with Ar to 50 vol.% [$N_2(50)/AR$] in both cases.

In Sample BJ, the target was changed to a target wherein graphite was provided on a polycrystalline silicon at an area ratio of 1:9, and further the $PF_5(250)/H_2$ gas bomb 431 was changed to the Ar gas bomb.

In each of Samples BH through BJ, after formation of the photoconductive layer, the system was evacuated to $5\times10^{-7}$ Torr, followed by closing of all the valves, and the outlet pressure was adjusted to 1 Kg/cm$^2$ by opening of the valve 430 of the bomb 431. Thereafter, the inflow valve 428, the outflow valve 426 and the auxiliary valve 410 were opened to introduce the gas into the chamber. By adjustment of the auxiliary valve 410, the inner pressure was made $5\times10^{-4}$ Torr (reading on the pirani gage 411) and further the inner pressure was made $1\times10^{-2}$ Torr by the main valve 313, whereupon the shutter 408 was opened by operation of the shutter rod 406 and the high frequency power source 409 was turned on to input an alternate current of 13.56 MHz between the target 405 and the fixing member 403. After formation of an upper layer under these conditions for 20 minutes, the high frequency power source 409 was turned off, and the auxiliary valve 410, the inflow valve 426 and the outflow valve 428 were closed, followed by full opening of the main valve 413. After evacuation of the chamber to $10^{-5}$ Torr, the main valve 413 was closed and the chamber was made to atmospheric through the leak valve 412. Then, the substrate having formed respective layers thereon was taken out.

The thus prepared image forming members BA to BJ were subjected to toner image formations, whereby in each case there was obtained an image excellent in resolution, gradation and image density either by a combination of ⊖6 KV corona charging and ⊕ charged developer or a combination of ⊕6 KV corona charging and ⊖ charged developer.

TABLE 6

| Upper layer Sample No. | Forming conditions: Starting gas or Target | Flow amount gas (or area) ratio | Preparation method | Power (W) | Layer thickness (Å) |
|---|---|---|---|---|---|
| BA | $SiH_4$ (dil., to 10 vol. % with $H_2$) $C_2H_4$ (dii., to 10 vol. % with $H_2$) | $SiH_4(10)/H_2$: $C_2H_4(10)/H_2$ = 1:9 | Glow | 3 | 120 |
| BB | $SiH_4$ (dil., to 10 vol. % with $H_2$) $N_2$ | $SiH_4(10)/H_2$: $N_2$ = 1:10 | Glow | 3 | 120 |
| BC | $SiH_4$ (dil., to 10 vol. % with $H_2$) $NH_3$ (dil., to 10 vol. % with $H_2$) | $SiH_4(10)/H_2$: $NH_3(10)/H_2$ = 1:2 | Glow | 3 | 120 |
| BD | $SiF_4$ ($H_2$ content: 10 vol. %) $C_2H_4$ (dil., to 10 vol. % with $H_2$) | $SiF_4/H_2(10)$: $C_2H_4(10)/H_2$ = 1:9 | Glow | 60 | 120 |
| BE | $SiF_4$ ($H_2$ content: 10 vol. %) $NH_3$ (dil., to 10 vol. % with $H_2$) | $SiF_4/H_2(10)$: $NH_3(10)/H_2$ = 1:20 | Glow | 60 | 120 |
| BF | $SiF_4$ ($H_2$ content: 10 vol. %) $N_2$ | $SiF_4/H_2(10)$: $N_2$ = 1:50 | Glow | 60 | 120 |
| BG | $Si(CH_3)_4$ (dil., to 10 vol. % with $H_2$) | | Glow | 3 | 120 |
| BH | Polycrystalline Si target $N_2$ (dil., to 50 vol. % with Ar) | | Sputter | 100 | 200 |
| BI | $Si_3N_4$ target $N_2$ (dil., to 50 vol. % with Ar) | | Sputter | 100 | 200 |
| BJ | Polycrystalline Si target, Graphite target, Ar | | Sputter | 100 | 200 |

What we claim is:

1. A photoconductive member, comprising a support, a photoconductive layer comprising an amorphous material containing hydrogen atoms or halogen atoms in a matrix of silicon atoms, and an intermediate layer comprising an electrically insulating oxide having a layer thickness of 30 to 1000 Å, which is provided between said support and said photoconductive layer.

2. A photoconductive member according to claim 1, wherein the oxide is a metal oxide.

3. A photoconductive member according to claim 1, wherein the content of hydrogen atoms is 1 to 40 atomic %.

4. A photoconductive member according to claim 1, wherein the content of halogen atoms is 1 to 40 atomic %.

5. A photoconductive member according to claim 1, wherein the sum of the contents of hydrogen atoms and halogen atoms is 1 to 40 atomic %.

6. A photoconductive member according to claim 1, wherein the layer thickness of the photoconductive layer is 1 to 100μ.

7. A photoconductive member according to claim 1, wherein there is further provided an upper layer on the photoconductive layer.

8. A photoconductive member according to claim 7, wherein the upper layer comprises an electrically insulating oxide.

9. A photoconductive member according to claim 8, wherein the oxide is a metal oxide.

10. A photoconductive member according to claim 7, wherein the upper layer comprises an amorphous material composed of silicon atoms as matrix and at least one atom selected from the group consisting of carbon atom, oxygen atom and nitrogen atom.

11. A photoconductive member according to claim 10, wherein the upper layer further contains at least one of hydrogen atom and halogen atom.

12. A photoconductive member according to claim 7, wherein the upper layer has a thickness of 30 to 1000 Å.

13. A photoconductive member according to claim 1, wherein the photoconductive layer contains an impurity which controlls the conduction type.

14. A photoconductive member according to claim 13, wherein the impurity is an element in the group III A of the periodic table.

15. A photoconductive member according to claim 14, wherein the element in the group III A of the periodic table is selected from the group consisting of B, Al, Ga, In and Tl.

16. A photoconductive member according to claim 13, wherein the impurity in the group V A of the periodic table.

17. A photoconductive member according to claim 16, wherein the element in the group V A of the periodic table is selected from the group consisting of N, P, As, Sb and Bi.

18. A photoconductive member according to claim 14, wherein the content of the element in the group III A of the periodic table is $10^{-6}$ to $10^{-3}$ atomic ratio based on silicon atoms.

19. A photoconductive member according to claim 16, wherein the content of the element in the group V A of the periodic table is $10^{-8}$ to $10^{-3}$ atomic ratio based on silicon atoms.

20. A photoconductive member, comprising a support, a photoconductive layer comprising an amorphous material containing matrix of silicon atoms, and an intermediate layer, provided between said support and said photoconductive layer, having the function of being capable of barring penetration of carriers from the side of the support into the photoconductive layer, said intermediate layer comprising an electrically insulating metal oxide and having a layer thickness of 30 to 1000 Å.

21. A photoconductive member according to claim 20, wherein hydrogen atoms are incorporated as constituent atoms in the photoconductive layer.

22. A photoconductive member according to claim 21, wherein the content of hydrogen atoms is 1 to 40 atomic %.

23. A photoconductive member according to claim 20, wherein halogen atoms are incorporated as constituent atoms in the photoconductive layer.

24. A photoconductive member according to claim 23, wherein the content of halogen atoms is 1 to 40 atomic %.

25. A photoconductive member according to claim 23, wherein the halogen atom is selected from the group consisting of F, Cl and Br.

26. A photoconductive member according to claim 20 wherein hydrogen atoms and halogen atoms are incorporated as constituent atoms in the photoconductive layer.

27. A photoconductive member according to claim 26, wherein the sum of the contents of hydrogen atoms and halogen atoms is 1 to 40 atomic %.

28. A photoconductive member according to claim 20, wherein there is further provided an upper layer on the photoconductive layer.

29. A photoconductive member according to claim 28, wherein the upper layer comprises an electrically insulating oxide.

30. A photoconductive member according to claim 29, wherein the oxide is a metal oxide.

31. A photosensitive member according to claim 28, wherein the upper layer comprises an amorphous material containing silicon atoms as matrix and at least one atom selected from the group consisting of carbon atom, oxygen atom and nitrogen atom.

32. A photoconductive member according to claim 31, wherein the upper layer further contains at least one of hydrogen atoms and halogen atoms.

33. A photoconductive member according to claim 28, wherein the upper layer has a thickness of 30 to 1000 Å.

34. A photoconductive member according to claim 1 or claim 20, wherein the photoconductive member is provided with a free surface for formation of charge images thereon and further a surface coating layer having a layer thickness of 0.5 to 70μ provided on said free surface.

* * * * *

UNITED STATES PATENT AND TRADEMARK OFFICE

CERTIFICATE OF CORRECTION

PATENT NO. : 4,403,026

DATED : September 6, 1983

INVENTOR(S) : SHIMIZU, ET AL.

It is certified that error appears in the above-identified patent and that said Letters Patent is hereby corrected as shown below:

Col. 4, line 39, "10" should be --102--.
Col. 11, line 3, "$Si_3$" should be --$Si_e$--.
Col. 11, line 16, "iron" should be --ion--.
Col. 18, line 51, after "313" insert --319--.
Col. 24, line 40, "uner" should be --under--.
Col. 25, line 10, "410" should be --401--.

Signed and Sealed this

*Twentieth* Day of *December 1983*

[SEAL]

*Attest:*

GERALD J. MOSSINGHOFF

*Attesting Officer*

*Commissioner of Patents and Trademarks*